US005564123A

United States Patent [19]

Grassick

[11] Patent Number: 5,564,123

[45] Date of Patent: Oct. 15, 1996

[54] SINGLE PIECE UPPER GARMENT FOR THE PHYSICALLY CHALLENGED

[76] Inventor: Betty Grassick, 19279 Arrowhead La. NW., N. Fort Myers, Fla. 33903

[21] Appl. No.: 418,024

[22] Filed: Apr. 6, 1995

[51] Int. Cl.[6] ..... A41D 13/00

[52] U.S. Cl. ..... 2/69; 2/114; 2/70

[58] Field of Search ..... 2/69, 114, 115, 2/118, 119, 120, 265, 266

[56] References Cited

U.S. PATENT DOCUMENTS

| | | | |
|---|---|---|---|
| 2,736,900 | 3/1956 | Koren | 2/114 |
| 3,276,036 | 10/1966 | Cater | 2/114 |
| 3,344,438 | 10/1967 | Title . | |
| 3,490,072 | 1/1970 | Keltner . | |
| 3,977,982 | 12/1976 | Holland | 35/56 |
| 4,258,440 | 3/1981 | McGowan | 2/114 |
| 4,370,757 | 2/1983 | Richmond | 2/400 |
| 4,434,511 | 3/1984 | Weiser | 2/114 |
| 4,638,509 | 1/1987 | Charron | 2/2.1 R |
| 4,644,589 | 2/1987 | Pettis | 2/109 |
| 4,675,918 | 6/1987 | O'Brien | 2/402 |
| 4,698,848 | 10/1987 | Buckley | 2/114 |
| 4,754,500 | 7/1988 | Brucato | 2/105 |
| 4,787,101 | 11/1988 | Feinberg | 2/114 X |
| 4,914,756 | 4/1990 | Grassick | 2/227 |
| 4,964,173 | 10/1990 | Gordon | 2/114 |
| 5,008,959 | 4/1991 | Coppage, Jr. et al. | 2/2.5 |
| 5,062,159 | 11/1991 | Jakub | 2/114 |
| 5,097,535 | 3/1992 | Dye et al. | 2/114 X |
| 5,157,789 | 10/1992 | Klass | 2/114 |
| 5,184,351 | 2/1993 | Benstock | 2/114 |
| 5,325,538 | 7/1994 | Schoenweiss et al. | 2/2.5 |

FOREIGN PATENT DOCUMENTS

| | | | |
|---|---|---|---|
| 1374231 | 8/1964 | France | 2/232 |

*Primary Examiner*—C. D. Crowder
*Assistant Examiner*—Shirra Jenkins
*Attorney, Agent, or Firm*—Richard C. Litman

[57] ABSTRACT

A single piece upper garment provides for ease of donning and removal by a physically challenged person and/or assistant or caretaker. The garment is formed of one or more sheets or sections of material in which all openings (neck, arms, and torso or trunk) are separable along at least one seam thereof, so the garment may be laid out substantially flat. The back portion may be placed against the back of a person (or the person may lie on the back portion), and the front portion wrapped around the person and closed along a lateral seam, similar to a conventional sewn side seam in a shirt or the like. The shoulders may then be closed, and the sleeves (if any) wrapped about the arms and closed, thereby providing a garment having a conventional appearance but providing for ease of donning and removal. The garment may include pockets and other conventional features, and may also include decorative but non-functional components such as a simulated front buttoned closure. The result is an outer garment having a conventional appearance for public wear by physically challenged persons. In another embodiment, the garment may have a simpler construction without sleeves, providing for use as a gown, house coat, shift, or night shirt type of garment.

18 Claims, 4 Drawing Sheets

SINGLE PIECE UPPER GARMENT FOR THE PHYSICALLY CHALLENGED

FIELD OF THE INVENTION

The present invention relates generally to specialized clothing and apparel, and more specifically to sleeved and sleeveless upper garments (i. e., essentially covering the torso) formed as a single sheet of material, with no permanently closed passages (sleeves, neck holes, etc.) formed therein. At least one seam or edge along any such passage is openable by means of a reusable closure. The present garments provide for ease of donning and removal by persons having limited manual dexterity for whatever reason, and/or for a caretaker of such a person, while providing a garment having a standard and finished appearance when donned.

BACKGROUND OF THE INVENTION

It has become recognized that the physically handicapped, or physically challenged, have needs and desires just as do physically able persons, and generally desire to live as normal a lifestyle as is permitted by their disability. In the past, such persons were often restricted to a hospital or other facility, or to their home, where their disability precluded outside activities to any appreciable degree. Accordingly, in the past there has been no great demand for clothing for such persons, which had the appearance of standard clothing and yet could be easily donned and removed by such physically challenged persons (or their caretakers).

More recently, however, recognition has been given to the special needs and problems of such individuals (e. g., Federal requirements for access to public buildings by the physically handicapped, etc.), and such persons are encouraged to spend more time in the outside world. Accordingly, they have need to be dressed and clothed appropriately. The initial situation of such individuals already places them at a disadvantage, as they are limited to a wheelchair or other such aid, and the lack of appropriate attire is demeaning to say the least. While some such individuals are capable of donning standard clothing, at least given sufficient time, the effort required is generally far above that required for physically able persons, who accomplish such actions daily as a matter of course with no particular thought or effort. If the disabled person is incapable of such for him or herself, then a caretaker must dress (or at least assist in dressing) the person, which also requires a great deal of effort for all parties concerned.

Thus, a need will be seen for apparel, particularly upper garments adapted for wear on the torso or upper body of the individual, which apparel presents the appearance and fit of standard clothing (i. e., shirts, blouses, etc.), yet provides extreme ease in donning and removal. The garments must provide at least one seam along each normally closed tubular element (torso, sleeves, neck opening, etc.) which is easily opened and closed by a reusable closure. While at least one embodiment is directed to outer wear for use in public, another embodiment comprises a night shirt, dressing gown, or the like which is also easily applied and removed by disabled persons or by their caretakers.

DESCRIPTION OF THE PRIOR ART

U.S. Pat. No. 3,344,438 issued to Jack Title on Oct. 3, 1967 describes a One Piece Panty Design wherein the continuous front and back panels are arranged to be cut respectively with straight and bias layouts. The appropriate edges are then permanently joined to provide leg and waist openings. No provision is made for openable seams for ease of donning or removal, nor for any single piece construction of any upper garments, whether for outer wear or for more private wear.

U.S. Pat. No. 3,490,072 issued to Raymond O. Keltner on Jan. 20, 1970 describes a Medical Patient's Gown having a general configuration somewhat resembling one of the embodiments of the present invention. However, the Keltner gown may be made of a paper material with adhesive attachment means for the openable seams for disposable use. The present invention is considerably more durable, being indefinitely reusable over a considerable number of wearings of the garment.

U.S. Pat. No. 3,997,982 issued to Esther S. Holland on Dec. 21, 1976 describes a Training Vest Or The Like for the purpose of training children or the handicapped to manipulate various types of clothing fasteners (buttons, zippers, snaps, etc). The vest comprises a vest portion with removable front panels, with the panels each having different types of fasteners thereon. The present garments are adapted to provide for ease of donning and removal by the physically challenged and/or their caretakers, rather than intentionally providing removable panels requiring a greater degree of manipulatory skills, as provided by the Holland vest.

U.S. Pat. No. 4,258,440 issued to Malissa McGowan on Mar. 31, 1981 describes Clothes For The Physically Handicapped comprising both lower and upper garments. The panels are secured together by means of hook and loop fastening material (e. g., Velcro™), as used in the present apparel. However, it is noted that the shoulder portions of the McGowan upper garment are permanently closed, thus providing a permanently closed neck opening and requiring the garment to be pulled over the head of the wearer. Such an operation may not be possible for the wearer, depending upon the degree of their physical handicap; merely raising the arms above the head can be extremely difficult, if not impossible, for many persons suffering from severe arthritis or other physical problems. The present garment, on the other hand, is devoid of any topologically toroidal configurations (i.e., neck openings, etc.) in its open disposition; all openings (neck, arm, and waist or leg) may be completely opened to allow the garment to be wrapped about the person, with the openings then sealed to provide the appearance of a conventional garment.

U.S. Pat. No. 4,370,757 issued to Bonnie D. Richmond on Feb. 1, 1983 describes a Garment With A Modesty Panel, comprising a joined pair of leg portions openable along their back seams up to the waist. The ankle portions of each leg are permanently closed, and straps with buckles are used to secure each of the leg portions about the wearer's respective legs. The present upper garment, with its continuous seam closures and completely separable openings, is not at all like the Richmond garment.

U.S. Pat. No. 4,638,509 issued to Rene Charron on Jan. 27, 1987 describes a Protective Outer Garment for Divers. The garment comprises a pair of leg portions each having an openable outer side seam, with the result being loosely similar to applicant's earlier issued U.S. Pat. No. 4,914,756 discussed further below. However, the Charron article is a lower garment, and in any case secures only with a series of straps and buckles providing attachment only at a plurality of spaced apart points along each seam, rather than the continuous security provided by the seam attachment means of the present garments.

U.S. Pat. No. 4,644,589 issued to Mary J. Pettis on Feb. 24, 1987 describes Self Administrable Garments For Arthritic Persons, comprising a pair of shorts and a sleeveless vest. The disclosure is directed primarily to underwear, unlike at least one embodiment of the present application. The Pettis upper garment or vest has permanently closed arm holes and shoulder straps thereover, although the front of the vest is openable using a continuous reusable closure (hook and loop fastening material). The closed toroidal topology of the arm holes provide a garment structurally and functionally unlike that of the present invention.

U.S. Pat. No. 4,675,918 issued to Ann N. O'Brien on Jun. 30, 1987 describes a One Piece Brief With Hook and Pile Closures. The undergarment is formed of a single flat sheet of material with hook and loop material along one side seam and across the crotch, or the front of the crotch. No upper garment having a neck opening is disclosed, nor is any outer garment disclosed, as provided by the present invention.

U.S. Pat. No. 4,698,848 issued to Mary C. Buckley on Oct. 13, 1987 describes a Blouse For Cardiac Patients. A front, rather than side seam closure, is provided, and the arm openings are permanently closed, requiring the wearer to slip his or her arms through the openings, rather than having the openings or sleeves closed about the arms. Velcro™ closure is disclosed, but comprises a plurality of separate, spaced apart patches, rather than the continuous, seam-like closure provided by the present invention.

U.S. Pat. No. 4,754,500 issued to Norma J. Brucato et al. on Jul. 5, 1988 describes Special Garments For The Disabled And Infirm, comprising outer garments with matching bib type overlays which may be removably placed over the upper front of the garments. The garments are provided with back (rather than side) closures and the sleeves are permanently closed tubular configurations, rendering the Brucato et al. garments difficult, if not impossible, for a disabled person to don and remove.

U.S. Pat. No. 4,914,756 issued to Betty Grassick on Apr. 10, 1990 describes an Article Of Clothing for The Handicapped comprising pants formed as a single, substantially flat sheet of material from multiple panels. The closure means is similar to that of the present invention, but provides for closure of the legs, rather than arm holes in an upper garment. Since the garment comprises a pair of pants, no neck opening or other upper garment features are disclosed.

U.S. Pat. No. 4,964,173 issued to David G. Gordon et al. on Oct. 23, 1990 describes Dignity Gowns having openable shoulder closures and one side seam closure of hook and loop fastening material. The shoulder closures, however, are formed of a plurality of spaced apart patches, providing discontinuous closures, unlike the continuous closures of the present garments which simulate sewn seams to provide a more finished appearance. Moreover, the front and rear portions of the Gordon et al. gown are completely separable from one another, unlike any of the embodiments of the present invention. The Gordon et al. gowns are adapted to opening of either the upper or lower portions independently of the other portion for medical examination purposes, unlike the present apparel which is adapted for ease of donning and removal by the physically challenged and/or their assistant(s) and which provides the appearance of standard articles of clothing.

U.S. Pat. No. 5,062,159 issued to Beatrice Jakub on Nov. 5, 1991 describes a Patient's Hospital Gown having a front closure and openable closures atop the shoulders. All of the closures are spaced apart and discontinuous, unlike the continuous closures provided by the present invention to simulate permanently sewn seams. While side openings are disclosed, they are not closable, as provided by the single side closure and permanently closed opposite side of the present garment.

Finally, French Patent No. 1,374,231 to Etablissements Mary and published on Aug. 24, 1964 describes trousers somewhat resembling the apparel of applicant's previously issued U.S. Pat. No. 4,914,756. No upper garment, with corresponding sleeve and neck openings, is disclosed.

None of the above noted patents, taken either singly or in combination, are seen to disclose the specific arrangement of concepts disclosed by the present invention.

SUMMARY OF THE INVENTION

By the present invention, an improved single piece upper garment for the physically challenged, is disclosed.

Accordingly, one of the objects of the present invention is to provide an improved upper garment which includes recloseable openings formed continuously along at least one side seam and the tops of both shoulders of the garment, thereby providing a garment which defines a topologically continuous sheet of material with no toroidal openings therein, when the closures of the garment are opened.

Another of the objects of the present invention is to provide an improved upper garment which may include left and right sleeves, each defining a generally semicylindrical configuration with reusable closures extending continuously along the upper sides thereof.

Yet another of the objects of the present invention is to provide an improved upper garment which is reusable, and which is formed of fabric material.

Still another of the objects of the present invention is to provide an improved upper garment which is adapted for ease of donning and removal by a physically challenged person, and/or his or her assistant, and which in at least one embodiment is further adapted for use as an outer garment for public wear.

A further object of the present invention is to provide an improved upper garment which in at least one other embodiment is adapted for wear in private as casual attire by a physically challenged person, as a gown, house dress, night shirt, or the like.

An additional object of the present invention is to provide an improved upper garment which may include means providing for the removable attachment of a collar or the like across the openable shoulder seams thereof, and which may further include decorative but non-functional trim components such as simulated buttoned openings thereon, as well as other functional components, such as pockets.

A final object of the present invention is to provide an improved single piece upper garment for the physically challenged for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
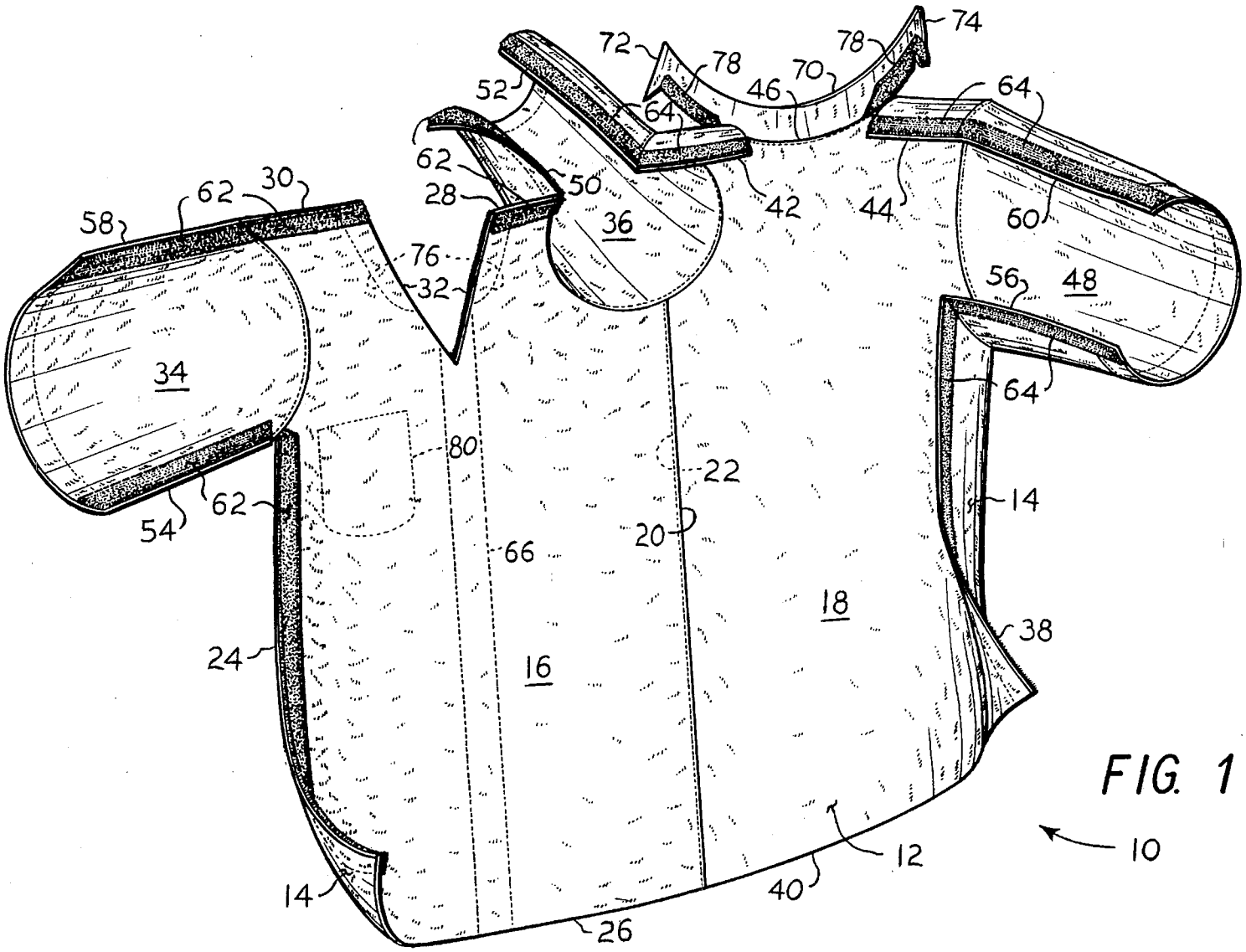
FIG. 1 is a perspective view of the interior surface of a first embodiment of the present garment in an open disposition, showing the various closable seams therein and other features providing use as an upper garment easily donned and removed by physically challenged persons and having conventional appearance and adapted for public wear.
Figure 2:
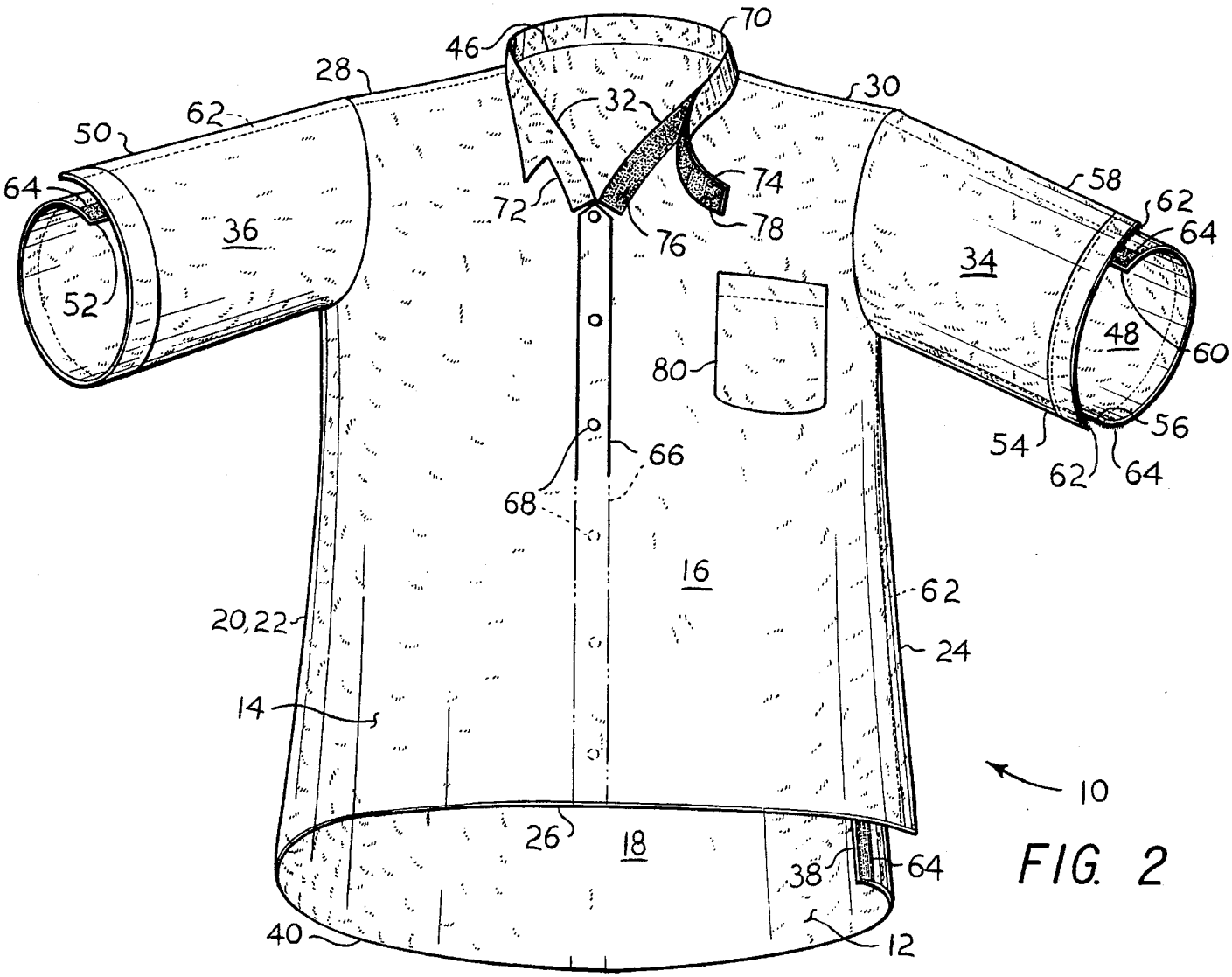
FIG. 2 is a front perspective view of the upper garment of FIG. 1, in a substantially closed disposition.

Referring now particularly to FIGS. 1 and 2 of the drawings, the present invention will be seen to relate to a single piece sleeved upper garment 10 particularly adapted for ease of donning and removal by the physically challenged, and/or by means of a caretaker for the physically challenged person. The present garment 10 is configured especially for use as outer wear (i. e., shirt, blouse, etc.), but may be adapted for other wear, as desired.

FIG. 1 provides a view of the present garment 10 in an open disposition, as viewed primarily from the inner surface 12 thereof. (Portions of the opposite, outer surface 14 are also shown folded over for clarity.) The garment 10 is essentially formed of a front panel 16 and a rear panel 18, which panels 16 and 18 may be formed as a single, unitary sheet of material (as in the garment of FIGS. 3 and 4), or may alternatively be formed of two separate sheets and secured together along a common seam at the second lateral edge 20 of the first panel 16 and the adjacent first lateral edge 22 of the second panel 18. This construction may be preferable, in that it is desired that the present garment 10 provide an appearance resembling a standard upper garment to the greatest degree possible, including conventional lateral seams as found in such garments.

The front panel 16 is defined by a first lateral edge 24 opposite the second lateral edge 20, a bottom edge 26 extending between the first and second lateral edges 24 and 20, a first shoulder edge 28 and an opposite second shoulder edge 30, which shoulder edges 28 and 30 are separated by a neck edge 32. The shoulder edges 28 and 30 are further separated from their respective first and second lateral edges 24 and 20 respectively by the front member 34 of a first sleeve and a second sleeve 36.

The rear panel 18 is similarly formed, having a first lateral edge 22, an opposite second lateral edge 38, and a bottom edge 40. The upper portion of the rear panel 18 is defined by a first shoulder edge 42 and an opposite second shoulder edge 44, with the shoulder edges 42 and 44 being separated by a rear panel neck edge 46. The rear panel first and second shoulder edges 42 and 44 are in turn separated from their respective first and second lateral edges 22 and 38, by the second sleeve 36 (which is common between the two panels 16 and 18) and the first sleeve rear member 48.

The above described front and rear panels 16 and 18 are generally congruent, with allowance being made for the differences in cut between front and back panels according to patterns for conventional fit. It will be seen that, with the front and rear panels 16 and 18 being openable along their respective first and second lateral edges 24 and 38, and the front and rear members 34 and 48 being completely separable, along with the separable first and second upper edges 50 and 52 of the second sleeve 36, that the present garment 10 defines a topologically continuous sheet is completely devoid of any tubular or other passages or toroidal openings therethrough when in an open configuration. Thus, no bodily members (arms, neck, etc.) need be manipulated to pass through any such openings.

The above described structure provides for ease of donning and removing the present upper garment 10, as a physically challenged person may even be able to don or remove the garment 10 by him or herself. The garment 10 may be laid out generally flat, with the individual then rolling over onto the rear or back panel 18 of the garment 10, in a supine position. The front panel 16 may then be wrapped about the front of the individual and secured to the rear panel 18 along their mating edges 24 and 38. The first and second edges 50 and 52 of the second sleeve 36 may then be secured together to close the second sleeve 36, and the front and rear portions 34 and 48 of the first sleeve may also be secured together, with the lower edges 54 and 56 and upper edges 58 and 60 respectively of the front and rear portions 34 and 48 of the first sleeve mating with one another to complete the first sleeve closure and thus complete the closure of the garment 10. Donning of the present garment 10 by a person in an upright position is even simpler, as the rear panel 18 need only be positioned across the wearer's back, with the above closure steps being made to complete the donning of the garment 10.

The closures used in the present garment 10 are preferably extremely simple to use, requiring no more than some degree of pressure to secure, and further being reusable many times over. The closures should be disposed continuously along an openable edge, in order to resemble more closely a continuously sewn seam when they are closed. Preferably, the present garment 10 is formed of a durable material providing for numerous wearings. Fabric is preferred, in order to provide the required durability and also to provide an appearance closely resembling that of a conventional upper garment.

It has been found that mating hook and loop fastening material (e. g., Velcro™) works well for the closure means of the present upper garment 10, as such material may be secured to appropriate edges of the garment 10 in continuous, elongate strips as required. In the example of FIGS. 1 and 2, the inner surface 12 of the first lateral edge 24 of the front panel 16, the inner surfaces of the first and second shoulder edges 28 and 30 of the front panel 16, the inner surfaces of the upper and lower edges 58 and 54 of the first sleeve front member 34, and the inner surface of the first upper edge 50 of the second sleeve 36 each include first temporary and reusable fastener material 62 secured therealong (e.g., sewn). The outer surfaces of the corresponding parts of the balance of the garment 10, i. e., the second lateral edge 38 and first and second shoulder edges 42 and 44 of the rear panel 18, the upper and lower edges 60 and 56 of the first sleeve rear member 48, and the second upper edge 52 of tile second sleeve 36, are provided with continuous strips of a second temporary and reusable fastener material 64 secured therealong. The first and second fastener materials are mating and complementary, and may comprise the hook and loop (or loop and hook) components of hook and loop fastening material. However, other fastening means may be used as desired.

The resulting assembly will resemble the substantially closed garment 10 shown in FIG. 2. (It will be understood that the openable closures of the garment 10 of FIG. 2 are shown in a loose relationship to one another, in order to show clearly the various edges and openable closures and seams of the garment 10.) The above construction also provides for additional features in such a garment 10, as discussed immediately following.

Conventional shirts, blouses and the like, are often provided with front button or other closures, as well as collars, pockets, etc. While a front closure of any type is not required in the present upper garment 10, the simulation of such provides a garment more closely resembling a standard shirt or the like. It has long been said that "clothes make the man," and thus, the provision of clothing having a more standardized appearance for such a physically challenged person, leads those around that person to perceive fewer differences between that person and others. This can be important to the psychological well being of the physically challenged person, as he or she interacts with others in the world.

Accordingly, a simulated front closure trim strip 66 may be provided on the front or outer surface 14 of the front panel 16. The trim strip may include buttons 68 thereon, or other decorative trim, as desired, and may extend partially down the front panel 16 as shown in solid lines, to simulate a "pullover" type shirt, or alternatively may continue downward to the bottom edge 26 of the front panel 16 to simulate a front buttoning type shirt or blouse, as shown by the continuation of the trim strip 66 in broken lines.

Similarly, many shirts and blouses are provided with collars. While the present garment 10 need not be equipped with such, a more formal shirt or blouse may be simulated by providing a collar 70, if desired. As the front and rear panels 16 and 18 separate at the shoulders, some means must be provided to allow the collar 70 to separate from one or the other panels 16 or 18. In the embodiment shown in FIGS. 1 and 2, the collar 70 is permanently secured (e.g., stitched) to the neck edge 46 of the rear panel 18, and has opposite first and second front extensions 72 and 74 extending therefrom. The collar extensions 72 and 74 are adapted to be placed around the sides of the neck of the wearer when the present garment 10 is fastened about the wearer, and temporarily secure to two first temporary and reusable collar fastener strips 76 disposed to each side of the outer surface of the neck edge 32 of the front panel 16. The collar extensions 72 and 74 are provided with mating second temporary and reusable neck edge fastener strips 78, providing attachment to the mating first collar attachment strips 76 of the neck edge 32. The result is a garment 10 having the appearance of a finished and formal collared shirt or blouse.

In addition to the front trim strip 66 and collar 70 trim articles, the garment 10 may also be provided with one or more breast or other pockets 80, as desired. Such a pocket(s) 80 may be fully functional, as it has no bearing upon the assembly of the garment 10. While only one pocket 80 is shown in FIGS. 1 and 2, additional pockets may be provided to either side of the upper front panel 16, and/or to other areas of the garment 10 as desired.

The above upper garment 10 provides a well dressed appearance for physically challenged individuals, even though the construction of the garment 10 is considerably different from conventional upper garments used as outer wear. While FIGS. 1 and 2 disclose a garment 10 having an openable closure to the left side, it will be apparent that a permanent seam may be formed along the left edges of the front and rear panels, and the openable seam provided to the right side, if desired. Thus, the present garment 10 may provide proper dress for individuals having greater or lesser mobility to one side of the body or the other. Another alternative may be provided in the sleeve length, as desired, while shorter sleeves are shown in FIGS. 1 and 2, the present garment 10 is readily adaptable to any practicable sleeve length desired.

Figure 3:
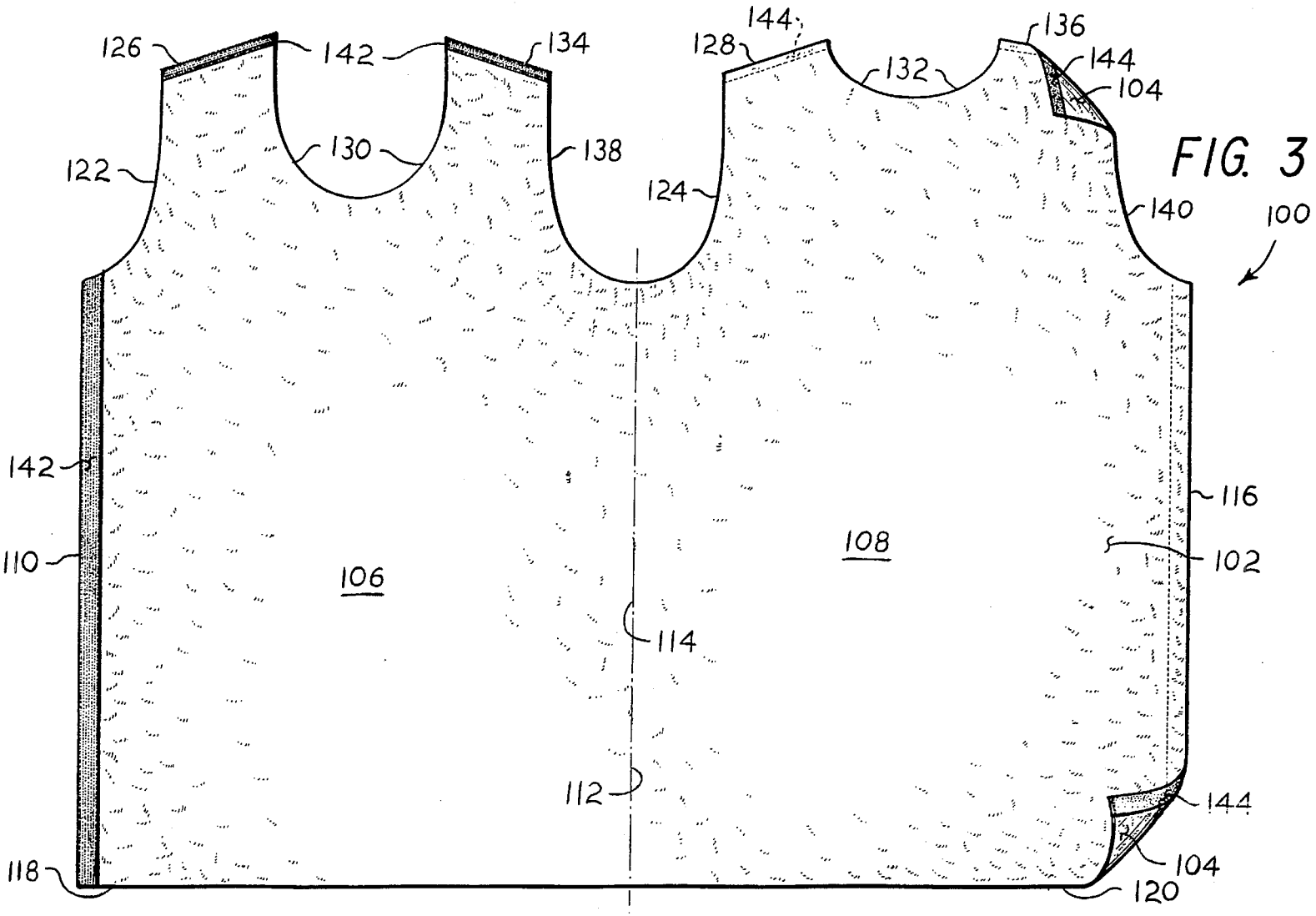
FIG. 3 is a plan view of a second embodiment of the present garment in an open position, showing the various closable seams and other features providing for use as a garment for private wear.
Figure 4:
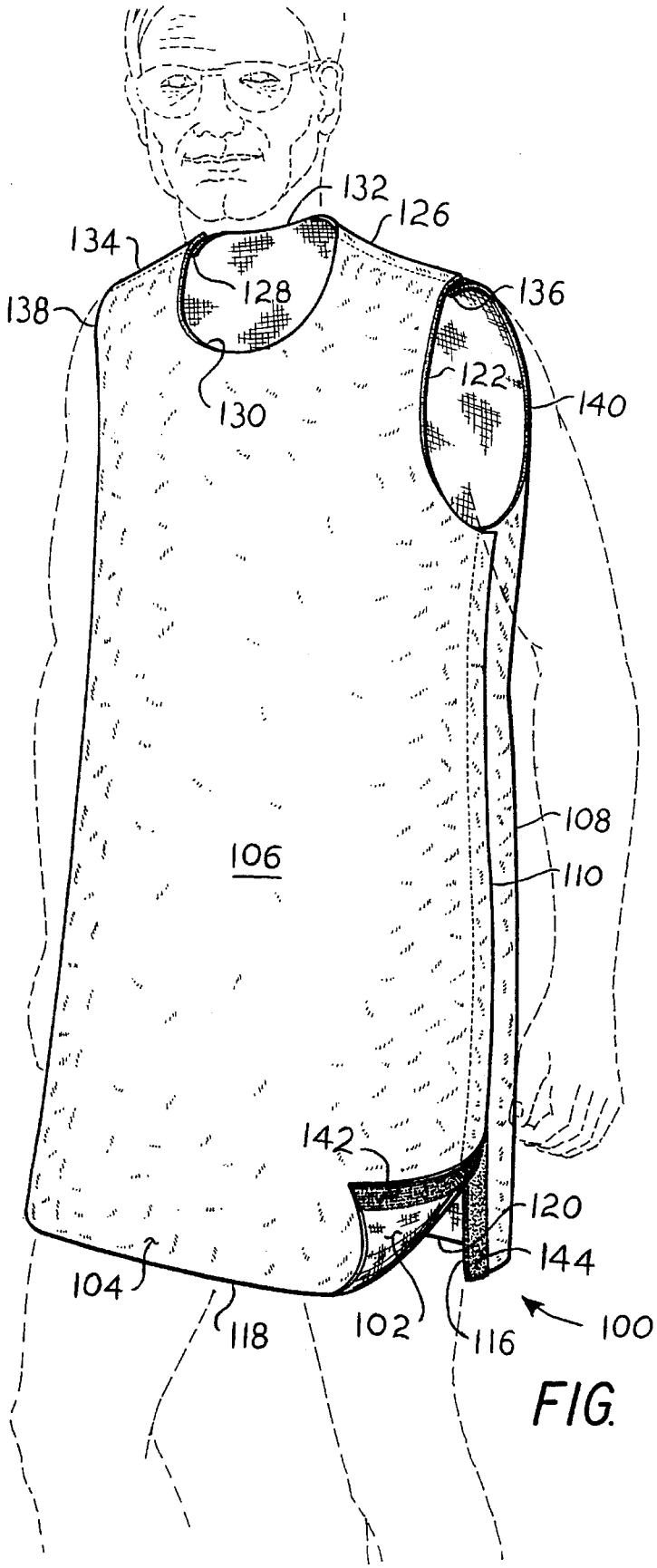
FIG. 4 is a left side perspective view of the garment of FIG. 3, showing its closed configuration as it would be worn by an individual.

FIGS. 3 and 4 disclose a simplified, alternative embodiment of the present upper garment, providing for more casual wear in a more private environment. The upper garment 100 of FIGS. 3 and 4 may be formed of a single, unitary sheet of material having an inner surface 102 and an opposite outer surface 104, and comprising a front panel 106 and a rear panel 108 devoid of openings therethrough, as in the outer garment of FIGS. 1 and 2. The garment 100 includes a front panel first lateral edge 110 and opposite second lateral edge 112, which front panel second lateral edge 112 may be common with the first lateral edge 114 of the rear panel 108. A rear panel second lateral edge 116 defines the second lateral boundary of the open garment 100.

The front and rear panels 106/108 each further include a bottom edge, respectively 118/120, a first arm edge 122/124, a first shoulder edge 126/128, a front and a rear neck edge 130/132, a second shoulder edge 134/136, and a second arm edge 138/140. The inner surface 102 of the first lateral edge 110 of the front panel 106 includes a continuous strip of temporary and reusable first fastener means 142 therealong, reaching from the bottom edge 118 to the first arm edge 122 of the front panel, while the outer surface 104 of the second lateral edge 116 of the rear panel 108 includes a mating, complementary continuous strip of temporary, reusable second fastener 144 therealong, serving to mate with the first lateral edge fastener strip 142 to secure the two otherwise open lateral edges 110 and 116 together. In a like manner, the inner surface of the two shoulder edges 126 and 134 of the front panel 106 also each include a strip of first fastener material 142 continually therealong. The first and second shoulder edges 128 and 136 of the outer surface of the second panel 108 also each include a mating, complementary strip of second fastener material 144 therealong, serving to attach the first shoulder edge 126 of the first panel 106 to the second shoulder edge 136 of the second panel 108, and to attach the second shoulder edge 134 of the first panel 106 to the first shoulder edge 128 of the second panel 108. The fastening means is preferably hook and loop fastening material, as described above in the description of the first embodiment. It will be noted that either the hook portion or the loop portion may be secured to either the first panel 106 or the second panel 108 as desired, so long as mating fastening strips complement one another.

The result of the above closures of the lateral edges and shoulders of the garment 100 of FIG. 3, produces a garment as shown in FIG. 4. The garment 100 may be donned and removed easily, similarly to the method described in the discussion above of the outer garment 10, but provides even greater ease and simplicity due to the lack of sleeves and other accessories. The garment 100 may be made in any practicable length, but preferably is sufficiently long to extend from the shoulders at least to the mid-thigh region of a person wearing the garment 100. Thus, the garment 100 is suitable for use as a nightgown or night shirt, or as a dressing gown, house dress, or other casual attire suitable for wear in the privacy of one's own quarters, and provides sufficient ease of donning and removal that all persons but the most seriously handicapped are capable of such donning and removal without assistance, thus preserving the privacy and dignity to which all humans are entitled.

It is to be understood that the present invention is not limited to the sole embodiments described above, but encompasses any and all embodiments within the scope of the following claims.

I claim:

1. A single piece sleeved upper garment for wear by a physically challenged individual and providing for ease of donning and removal thereof, said garment comprising:

a front panel having a first lateral edge, an opposite second lateral edge, a bottom edge, a first shoulder edge, an opposite second shoulder edge, and a centrally disposed neck edge, with said first shoulder edge and said second shoulder edge being separated respectively from said first lateral edge and said second lateral edge by a front sleeve member and a second sleeve;

a rear panel having a first lateral edge, an opposite second lateral edge, a bottom edge, a first shoulder edge, an opposite second shoulder edge, and a centrally disposed neck edge, with said first shoulder edge and said second shoulder edge being separated respectively from said first lateral edge and said second lateral edge by said second sleeve and a rear sleeve member;

a collar disposed about at least one said neck edge;

said collar being permanently secured to said neck edge of said rear panel, said front panel includes first temporary and reusable fastening means disposed along said outer surface of said neck edge, and said collar includes a first and a second front extension each having a neck edge mating surface having second temporary and reusable fastening means thereon, whereby;

said first and said second front extension of said collar are folded respectively over said first and second shoulder seams after said garment is secured about the person wearing said garment, thereby providing a collared neck opening for said garment;

said front sleeve member extending from said front panel and said rear sleeve member extending from said rear panel, with each defining a generally semicylindrical configuration and each further having a lower sleeve edge and an upper sleeve edge, and said second sleeve being openable and common between said front panel and said rear panel and having a separable first and second upper edge respectively extending along said second sleeve from said first shoulder edge of said front panel and said first shoulder edge of said rear panel;

said front panel and said rear panel having a common and continuous inner surface and opposite outer surface with said second lateral edge of said front panel being common with said first lateral edge of said rear panel, and said front panel, said rear panel, said front sleeve member, said rear sleeve member, and said openable second sleeve defining a topologically continuous sheet devoid of toroidal openings therethrough;

said first lateral edge, said first shoulder edge, said second shoulder edge, said lower sleeve edge and said upper sleeve edge of said front sleeve member, and said first upper edge of said second sleeve of said front panel each including a continuous and unbroken first temporary and reusable fastening means therealong, and said second lateral edge, said first shoulder edge, said second shoulder edge, said lower sleeve edge and said upper sleeve edge of said rear sleeve member, and said second upper edge of said second sleeve of said rear panel each including a continuous and unbroken cooperating second temporary and reusable fastening means therealong;

said first fastening means of said first lateral edge, said first shoulder edge, said second shoulder edge, said lower sleeve edge and said upper sleeve edge of said front sleeve member, and said first upper edge of said second sleeve of said front panel temporarily fastening to said second fastening means respectively of said second lateral edge, said second shoulder edge, said first shoulder edge, said lower sleeve edge and said upper sleeve edge of said rear sleeve member, and said second upper edge of said second sleeve of said rear panel to provide an upper garment having a temporarily closed first side seam defined by said fastening means of said front panel first lateral edge and said rear panel second lateral edge, and an opposite permanently closed side defined by said front panel second lateral edge and said rear panel first lateral edge in common therewith:

said upper garment formed by temporarily fastening said first and said second temporary and reusable fastening means further having closed first and second shoulder seams, a closed first sleeve provided by respectively fastening said front sleeve member upper edge to said rear sleeve member upper edge and said front sleeve member lower edge to said rear sleeve member lower edge, and a closed second sleeve provided by fastening said first upper edge to said second upper edge of said second sleeve, a neck opening defined between said neck edge of said front panel and said neck edge of said rear panel, and a lower opening defined between said temporarily closed first side seam and said opposite permanently closed side, whereby;

said garment is donned by the physically challenged person by placing said rear panel inner surface adjacent the back of the physically challenged person and wrapping said front panel about the front of the person, temporarily fastening said front panel to said rear panel along said first side seam, temporarily fastening said first and second shoulder seams to provide said neck opening, temporarily fastening said first upper edge and said second upper edge of said second sleeve to close said second sleeve, and temporarily fastening said front sleeve member upper edge to said rear sleeve member upper edge and said front sleeve member lower edge to said rear sleeve member lower edge to close said first sleeve, to form a closed sleeved upper garment about the person.

2. The sleeved upper garment of claim 1 wherein:

at least said front panel and said rear panel are integrally formed of a single sheet of material.

3. The sleeved upper garment of claim 1 wherein:

said second lateral edge of said front panel is permanently joined to said first lateral edge of said rear panel completely and continuously therealong from said bottom edge to said second sleeve to form a continuous lateral seam extending from said bottom edge to said common second sleeve of said front panel and said rear panel.

4. The sleeved upper garment of claim 1 wherein:

said garment is reusable, and at least said front panel, said rear panel, said second sleeve, and said front sleeve member and said rear sleeve member comprising said first sleeve are formed of fabric material.

5. The sleeved upper garment of claim 1 wherein:

said first temporary and reusable fastening means and said second temporary and reusable fastening means each comprise cooperating hook and loop fastening material.

6. The sleeved upper garment of claim 1 wherein:

said first temporary fastening means is disposed along said inner surface of said first lateral edge, said first shoulder edge, said second shoulder edge of said front panel, said lower and said upper sleeve edge of said front sleeve member, and said first upper edge of said second sleeve, and said second temporary fastening means is disposed along said outer surface of said second lateral edge, said second shoulder edge, and said first shoulder edge of said rear panel, said lower and said upper sleeve edge of said rear sleeve member, and said second upper edge of said second sleeve.

7. The sleeved upper garment of claim 1 wherein:

each said sleeve comprises a short sleeve terminating no lower than the elbow of the person wearing said sleeved garment.

8. The sleeved upper garment of claim 1 including:

at least one pocket disposed upon said outer surface of said front panel.

9. The sleeved upper garment of claim 1 including:

a simulated closure trim strip disposed generally centrally upon said outer surface of said front panel and extending generally vertically and downwardly from said neck edge.

10. The sleeved upper garment of claim 9 wherein:

said simulated closure trim strip extends from said neck edge to said bottom edge of said front panel.

11. The sleeved upper garment of claim 9 wherein:

said simulated closure trim strip includes a plurality of buttons thereon.

12. A single piece upper garment for wear by a physically challenged individual and providing for ease of donning and removal thereof, said garment comprising:

a front panel having a first lateral edge, an opposite second lateral edge, a bottom edge, a first shoulder edge, an opposite second shoulder edge, a first arm edge, an opposite second arm edge, and a centrally disposed neck edge;

a rear panel having a first lateral edge, an opposite second lateral edge, a bottom edge, a first shoulder edge, an opposite second shoulder edge, a first arm edge, an opposite second arm edge, and a centrally disposed neck edge;

a collar disposed about at least one said neck edge;

said collar being permanently secured to said neck edge of said rear panel, said front panel includes first temporary and reusable fastening means disposed along said outer surface of said neck edge, and said collar includes a first and a second front extension each having a neck edge mating surface having second temporary and reusable fastening means thereon, whereby;

said first and said second front extension or said collar are folded respectively over said first and second shoulder seams after said garment is secured about the person wearing said garment, thereby providing a collared neck opening for said garment;

said front panel and said rear panel having a common and continuous inner surface and opposite outer surface with said second lateral edge of said front panel being common with said first lateral edge of said rear panel, and said front panel and said rear panel defining a topologically continuous sheet devoid of toroidal openings therethrough;

said first lateral edge, said first shoulder edge, and said second shoulder edge of said front panel each including a continuous and unbroken first temporary and reusable fastening means therealong, and said second lateral edge, said first shoulder edge, and said second shoulder edge of said rear panel each including a continuous and unbroken cooperating second temporary and reusable fastening means therealong;

said first fastening means of said first lateral edge, said first shoulder edge, and said second shoulder edge of said front panel temporarily fastening to said second fastening means respectively of said second lateral edge, said second shoulder edge, and said first shoulder edge of said rear panel to provide an upper garment having a temporarily closed first side seam defined by said fastening means of said front panel first lateral edge and said rear panel second lateral edge, and an opposite permanently closed side defined by said front panel second lateral edge and said rear panel first lateral edge in common therewith;

said upper garment formed by temporarily fastening said first and said second fastening means further having closed first and second shoulder seams, with first and second arm openings being defined respectively between said first arm edge of said front panel and said second arm edge of said rear panel and said second arm edge of said front panel and said first arm edge of said rear panel, a neck opening defined between said neck edge of said front panel and said neck edge of said rear panel, and a lower opening defined between said temporarily closed first side seam and said opposite permanently closed side, whereby;

said garment is donned by the physically challenged person by placing said rear panel inner surface adjacent the back of the physically challenged person and wrapping said front panel about the front of the person, temporarily fastening said front panel to said rear panel along said first side seam, and temporarily fastening said first and second shoulder seams to provide said first and second arm openings and said neck opening to form a closed garment about the person.

13. The upper garment of claim 12 wherein:

said front panel and said rear panel are integrally formed of a single sheet of material.

14. The upper garment of claim 12 wherein:

said second lateral edge of said front panel is permanently joined to said first lateral edge of said rear panel completely and continuously therealong from said bottom edge to said arm edge to form a continuous lateral seam extending from said lower edge to said second arm edge and said first arm edge respectively of said front panel and said rear panel.

15. The upper garment of claim 12 wherein:

said garment is reusable, and at least said front panel and said rear panel are formed of fabric material.

16. The upper garment of claim 12 wherein:

said first temporary and reusable fastening means and said second temporary and reusable fastening means each comprise cooperating hook and loop fastening material.

17. The upper garment of claim 12 wherein:

said first temporary fastening means is disposed along said inner surface of said first lateral edge, said first shoulder edge, and said second shoulder edge of said front panel, and said second temporary fastening means is disposed along said outer surface of said second lateral edge, said second shoulder edge, and said first shoulder edge of said rear panel.

18. The upper garment of claim 12 wherein:

said garment has a length defined between said neck opening and said lower opening, with said length being sufficient to extend downwardly from said neck opening at least to mid-thigh of the person wearing said garment.

* * * * *